US010134510B2

(12) United States Patent
Nakayama

(10) Patent No.: US 10,134,510 B2
(45) Date of Patent: Nov. 20, 2018

(54) CHIP RESISTOR AND METHOD FOR MANUFACTURING SAME

(71) Applicant: Panasonic Intellectual Property Management Co., Ltd., Osaka (JP)

(72) Inventor: Shogo Nakayama, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/303,731

(22) PCT Filed: Mar. 30, 2015

(86) PCT No.: PCT/JP2015/001823

§ 371 (c)(1),
(2) Date: Oct. 12, 2016

(87) PCT Pub. No.: WO2015/162858

PCT Pub. Date: Oct. 29, 2015

(65) Prior Publication Data

US 2017/0040091 A1 Feb. 9, 2017

(30) Foreign Application Priority Data

Apr. 24, 2014 (JP) ..... 2014-089753

(51) Int. Cl.
*H01C 1/032* (2006.01)
*H01C 1/142* (2006.01)
(Continued)

(52) U.S. Cl.
CPC ..... *H01C 1/032* (2013.01); *H01C 1/028* (2013.01); *H01C 1/142* (2013.01); *H01C 7/00* (2013.01);
(Continued)

(58) Field of Classification Search
CPC ..... H01C 1/032; H01C 1/028; H01C 1/142; H01C 7/00; H01C 17/02; H01C 17/006
(Continued)

(56) References Cited

U.S. PATENT DOCUMENTS 6,304,167 B1 * 10/2001 Nakayama ..... H01C 7/00 338/195
8,085,551 B2 * 12/2011 Karasawa ..... H01C 1/148 174/260
(Continued)

FOREIGN PATENT DOCUMENTS

JP 9-205005 8/1997
JP 11-168003 6/1999
(Continued)

OTHER PUBLICATIONS

International Search Report of PCT application No. PCT/JP2015/001823 dated Jun. 16, 2015.

*Primary Examiner* — Kyung Lee
*Assistant Examiner* — Iman Malakooti
(74) *Attorney, Agent, or Firm* — McDermott Will & Emery LLP

(57) ABSTRACT

A chip resistor includes an insulating substrate, a resistive element provided on an upper surface of the insulating substrate, a pair of upper-surface electrodes provided on respective ones of both end portions of an upper surface of the resistive element so as to expose a part of the upper surface of the resistive element from the upper-surface electrodes, and a protective layer that covers the part of the resistive element and that does not cover the pair of upper-surface electrodes. The pair of upper-surface electrodes have exposed upper surfaces and exposed edge surfaces, respectively. Each of the edge surfaces of the pair of upper-surface electrodes does not project outward from respective one of the edge surfaces of the insulating substrate. The chip
(Continued)

resistor can reduce a temperature coefficient of resistance to improve the temperature coefficient of resistance.

11 Claims, 8 Drawing Sheets

(51) Int. Cl.

| | |
|---|---|
| ***H01C 7/00*** | (2006.01) |
| ***H01C 17/02*** | (2006.01) |
| ***H01C 17/00*** | (2006.01) |
| ***H01C 1/028*** | (2006.01) |
| ***H01C 17/28*** | (2006.01) |
| *H01C 1/148* | (2006.01) |

(52) U.S. Cl.
CPC ..... *H01C 7/003* (2013.01); *H01C 17/006* (2013.01); *H01C 17/02* (2013.01); *H01C 17/281* (2013.01); *H01C 1/148* (2013.01)

(58) Field of Classification Search
USPC ..... 338/254, 307, 309
See application file for complete search history.

(56) References Cited

U.S. PATENT DOCUMENTS

| | | | | |
|---|---|---|---|---|
| 8,325,006 | B2 * | 12/2012 | Yoneda | H01C 1/028 338/309 |
| 2002/0050909 | A1 * | 5/2002 | Jinno | H01C 1/034 338/21 |
| 2008/0129443 | A1 * | 6/2008 | Tsukada | H01C 1/148 338/309 |
| 2009/0115569 | A1 * | 5/2009 | Urano | H01C 1/012 338/309 |

FOREIGN PATENT DOCUMENTS

| | | | |
|---|---|---|---|
| JP | 2001-351801 | 12/2001 | |
| JP | 2006-019323 | * 1/2006 | H01C 7/00 |
| JP | 2006-332413 | 12/2006 | |
| JP | 2007-088161 | 4/2007 | |

* cited by examiner

CHIP RESISTOR AND METHOD FOR MANUFACTURING SAME

CROSS-REFERENCE TO RELATED APPLICATIONS

This application is a U.S. national stage application of the PCT international application No. PCT/JP2015/001823 filed on Mar. 30, 2015, which claims the benefit of foreign priority of Japanese patent application 2014-089753 filed on Apr. 24, 2014, the contents all of which are incorporated herein by reference.

TECHNICAL FIELD

The present invention relates to a chip resistor used in various electronic devices and a method of manufacturing the chip resistor.

BACKGROUND ART

FIG. 9 is a cross-sectional view of conventional chip resistor 500. Chip resistor 500 includes insulating substrate 1, a pair of upper-surface electrodes 2 made of Cu provided on both end portions of insulating substrate 1, a resistive element 3 made of CuNi provided between the pair of upper-surface electrodes 2, a pair of uppermost surface electrodes 4 made of Cu provided on upper surfaces of the pair of upper-surface electrodes 2 and covering a part of resistive element 3, protective layer 5, a pair of side surface electrodes 6 provided on both side surfaces of insulating substrate 1, and a pair of plating layers 7 covering the pair of side surface electrodes 6. Protective layer 5 covers portions of the pair of uppermost-surface electrodes 4 connected with resistive element 3, the pair of upper-surface electrodes 2, and resistive element 3. The pair of plating layers 7 contact protective layer 5.

A conventional chip resistor similar to chip resistor 500 is disclosed in, e.g. PTL 1.

CITATION LIST

Patent Literature

PTL 1: Japanese Patent Laid-Open Publication No. 2007-88161

SUMMARY

A chip resistor includes an insulating substrate, a resistive element provided on an upper surface of the insulating substrate, a pair of upper-surface electrodes provided on respective ones of both end portions of an upper surface of the resistive element so as to expose a part of the upper surface of the resistive element from the upper-surface electrodes, and a protective layer that covers the part of the resistive element and that does not cover the pair of upper-surface electrodes. The pair of upper-surface electrodes have exposed upper surfaces and exposed edge surfaces, respectively. Each of the edge surfaces of the pair of upper-surface electrodes does not project outward from respective one of the edge surfaces of the insulating substrate.

The chip resistor can reduce a temperature coefficient of resistance to improve the temperature coefficient of resistance.

DETAIL DESCRIPTION OF PREFERRED EMBODIMENT

Figure 1:
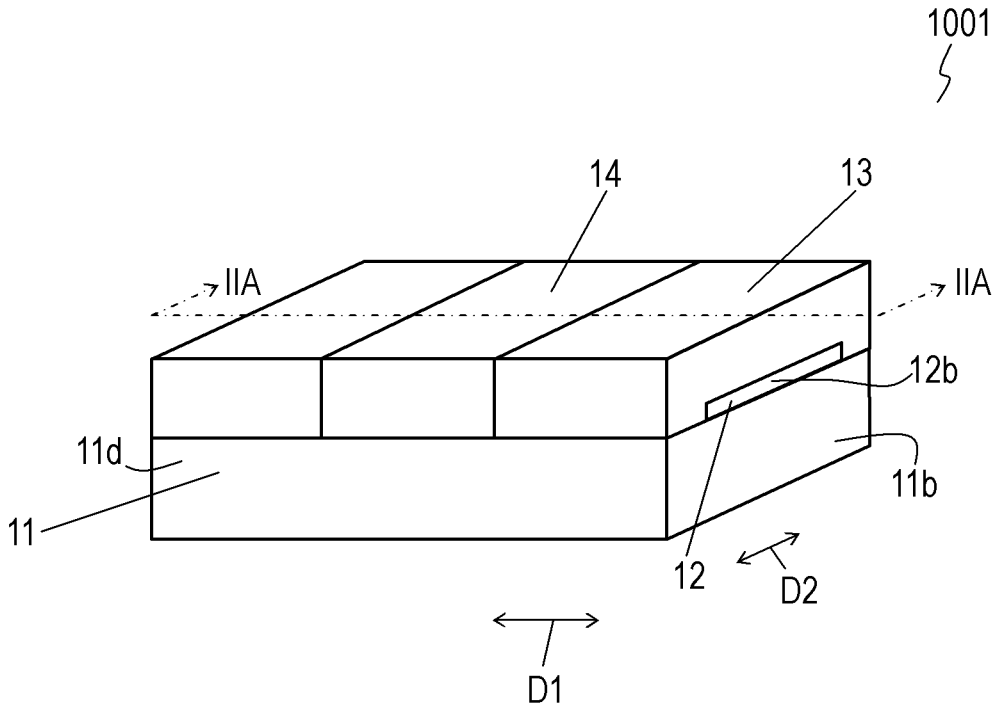
FIG. 1 is a perspective view of a chip resistor according to an exemplary embodiment.
Figure 2A:
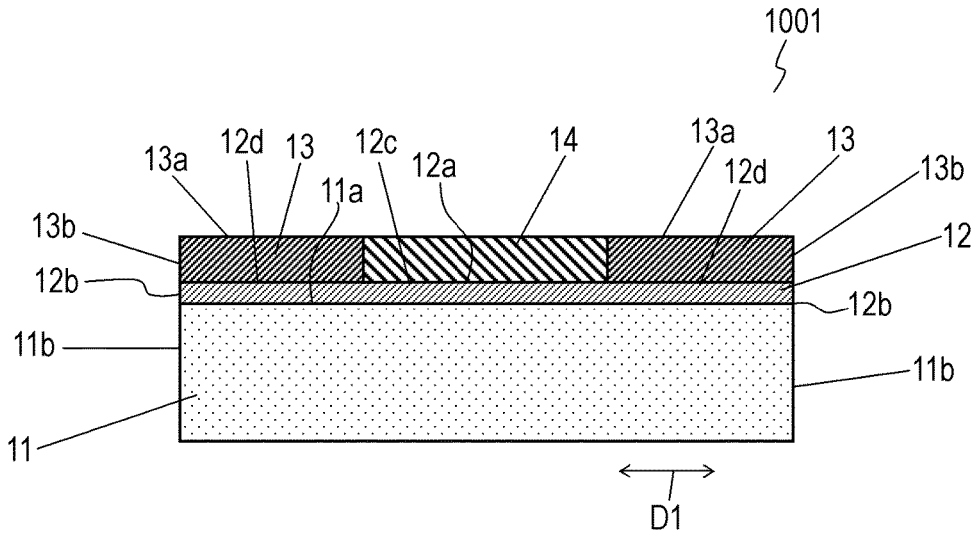
FIG. 2A is a cross-sectional view of the chip resistor on line IIA-IIA shown in FIG. 1.

FIG. 1 is a perspective view of chip resistor 1001 according to an exemplary embodiment. FIG. 2A is a cross-sectional view of chip resistor 1001 on line IIA-IIA shown in FIG. 1. Chip resistor 1001 includes insulating substrate 11, resistive element 12 provided on upper surface 11*a* of insulating substrate 11, a pair of upper-surface electrodes 13 provided on both end portions 12*d* of upper surface 12*a* of resistive element 12, and protective layer 14 provided between the pair of upper-surface electrodes 13. Protective layer 14 covers part 12*c* of resistive element 12 exposed from the pair of upper-surface electrodes 13. Upper surfaces 13*a* of the pair of upper surface electrodes 13 and edge surfaces 13*b* connected to upper surfaces 13*a* are exposed, and edge surfaces 13*b* of the pair of upper-surface electrodes 13 do not project outward from edge surfaces lib connected to upper surface 11*a* of insulating substrate 11. Both edge surfaces 12*b* of resistive element 12 arranged in direction D1 are exposed from edge surfaces 11*b* of insulating substrate 11 and edge surfaces 13*b* of upper-surface electrodes 13.

Insulating substrate 11 is made of alumina containing 96% of $Al_2O_3$. Upper surface 11*a* of insulating substrate 11 has a rectangular shape extending slenderly in direction D1 viewing from above. Direction D1 is parallel to upper surface 11*a*. The rectangular shape of upper surface 11*a* is wider in direction D1 than in direction D2 which is parallel to upper surface 11*a* and perpendicular to direction D1. The rectangular shape has long sides extending in direction D1 and short sides extending in direction D2. Protective layer 14 and the pair of upper-surface electrodes 13 are arranged in direction D1 so that protective layer 14 is positioned between the pair of upper-surface electrodes 13.

Resistive element 12 is formed on upper surface 11*a* of insulating substrate 11 by printing and firing a thick-film material made of, e.g. CuNi. Resistive element 12 has a bar shape exposed to both edge surfaces 11*b* of insulating substrate 11 arranged in a longitudinal direction (direction D1) of insulating substrate 11, but may have another shape. A trimming groove having an L-shape, a linear shape, or a U-shape may be formed by irradiating resistive element 12 with a laser beam to adjust the resistance of resistive element 12.

The pair of upper-surface electrodes 13 are provided on both-end portions 12*d* apart from each other in the longitudinal direction (direction D1) of upper surface 12*a* of resistive element 12, and are formed by printing and firing a thick-film material made of, e.g. Cu. Therefore, the pair of upper surface electrodes 13 are provided at short sides of insulating substrate 11. Upper surfaces 13*a* and edge surfaces 13*b* of the pair of upper-surface electrodes 13 are exposed outward from chip resistor 1001.

Each of edge surfaces 13*b* of the pair of upper-surface electrodes 13 does not project outward from respective one of edge surfaces 11*b* of insulating substrate 11, in other words, each of edge surfaces 13*b* is aligned to respective one of edge surfaces 11*b* of insulating substrate 11 or positioned inner than respective one of edge surfaces 11*b*. Edge surfaces 11*b* are apart from each other in the longitudinal direction (direction D1). In FIG. 1 and FIG. 2A, each of edge surfaces 13*b* of the pair of upper-surface electrodes 13 are aligned to respective one of edge surfaces 11*b* of insulating substrate 11. In FIG. 2A, each of edge surfaces 12*b* of resistive element 12 is aligned to respective one of edge surfaces 13*b* of the pair of upper-surface electrodes 13 and respective one of edge surfaces 11*b* of insulating substrate 11.

Protective layer 14 is made of glass or epoxy resin and covers at least part 12*c* of resistive element 12 exposed from a portion on which the pair of upper surface electrodes 13 are not provided. Therefore, protective layer 14 covers part 12*c* of resistive element 12 exposed between the pair of upper-surface electrodes 13, but is not provided on upper surfaces 13*a* of the pair of upper-surface electrodes 13. More specifically, in chip resistor 1001 according to the embodiment, upper surfaces 13*a* of the pair of upper-surface electrodes 13 are completely exposed from protective layer 14.

Resistive element 12 may be exposed to side surfaces 11*d* of insulating substrate 11 arranged in direction D2. However, as shown in FIG. 1, the pair of upper-surface electrodes 13 and protective layer 14 are preferably exposed to side surfaces 11*d* of insulating substrate 11 while resistive element 12 is not exposed to side surfaces 11*d* of insulating substrate 11.

Figure 2B:
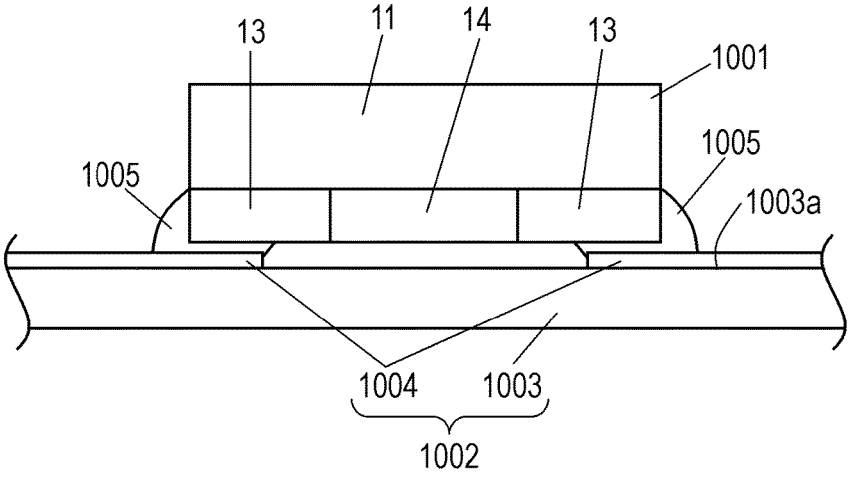
FIG. 2B is a side view of the chip resistor according to the embodiment mounted on a mother board.

FIG. 2B is a side view of chip resistor 1001 mounted onto mother board 1002. Mother board 1002 includes insulating board 1003 and at least a pair of wirings 1004 provided on surface 1003*a* of insulating board 1003. While being mounted, upper surfaces 13*a* of the pair of upper-surface electrodes 13 is directed downward so as to face surface 1003*a* of mother board 1002, and chip resistor 1001 is disposed. However, in order to simplify description, herein, the pair of upper-surface electrodes 13 of insulating substrate 11 are directed upward. A pair of mounting solders (fillets) 1005 provided on wirings 1003*b* are connected to upper surfaces 13*a* and edge surfaces 13*b* of the exposed pair of upper-surface electrodes 13, and chip resistor 1001 is mounted on mother board 1002.

Next, a method of manufacturing chip resistor 1001 according to the embodiment will be described below. FIGS. 3A to 3D, FIGS. 4A to 4D, and FIGS. 5A to 5D show the method of manufacturing chip resistor 1001.

Figure 3A:
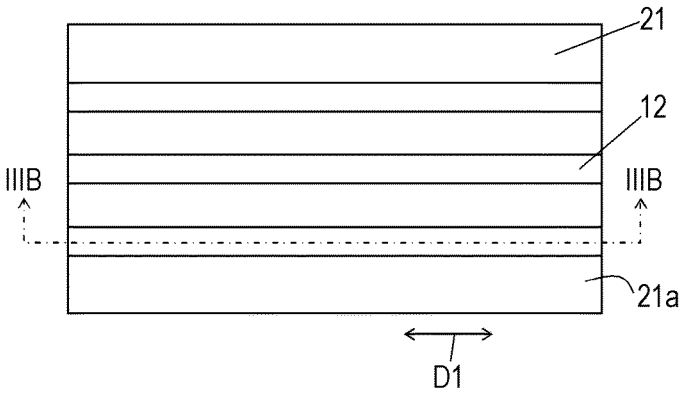
FIG. 3A is a top view of an insulating wafer for illustrating a method of manufacturing the chip resistor according to the embodiment.
Figure 3B:
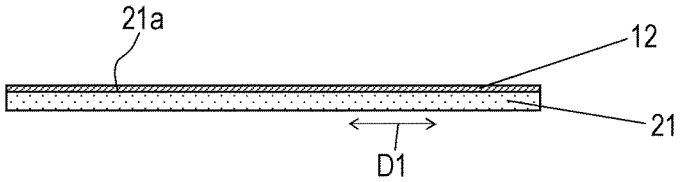
FIG. 3B is a cross-sectional view of the insulating wafer on line IIIB-IIIB shown in FIG. 3A.

FIG. 3A is a top view of insulating wafer 21 for illustrating the method of manufacturing chip resistor 1001. FIG. 3B is a cross-sectional view of insulating wafer 21 on line IIIB-IIIB shown in FIG. 3A. First, as shown in FIG. 3A and FIG. 3B, a thick-film material made of CuNi is printed and fired on upper surface 21*a* of insulating wafer 21 having a sheet shape to provide plural resistive elements 12 having strip shape. Plural resistive elements 12 have a thickness of about 30 μm and are extending from one end of insulating wafer 21 slenderly in direction D1 to another end of insulating wafer 21. Insulating wafer 21 is divided into chips constituting insulating substrates 11.

Figure 3C:
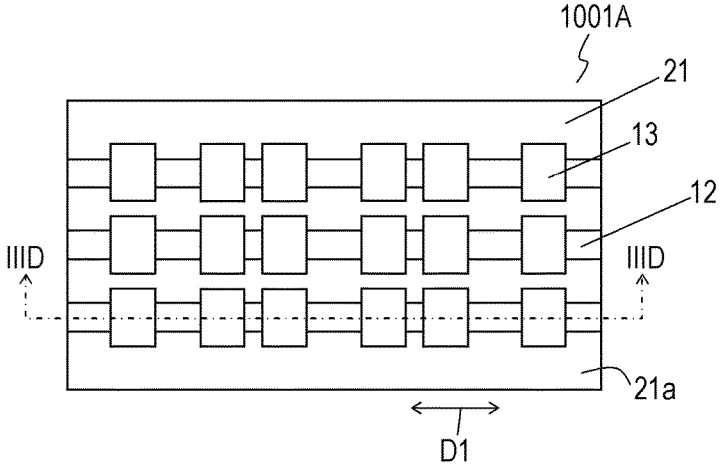
FIG. 3C is a top view of the insulating wafer for illustrating the method of manufacturing the chip resistor according to the embodiment.
Figure 3D:
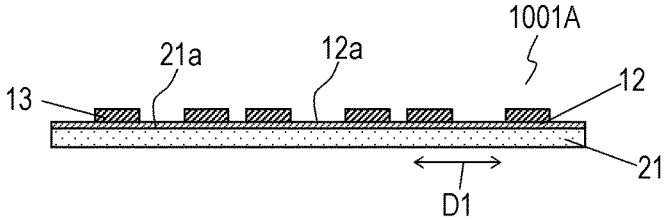
FIG. 3D is a cross-sectional view of the insulating wafer on line IIID-IIID shown in FIG. 3C.

FIG. 3C is a top view of insulating wafer 21. FIG. 3D is a cross-sectional view of insulating wafer 21 on line IIID-IIID shown in FIG. 3C. Next, as shown in FIG. 3C and FIG. 3D, thick-film materials made of Cu are printed and fired on upper surfaces 12*a* of resistive elements 12 to form plural upper surface electrodes 13, thus providing an intermediate component 1001A for manufacturing chip resistor 1001. According to the embodiment, upper surface electrodes 13 have a thickness of about 100 μm. Note that, in the drawing, upper surface electrode 13 is wider than resistive element 12, but may not be not wider. The thicknesses of resistive elements 12 and upper-surface electrodes 13 are not limited to the above described thicknesses.

A conductive film having a predetermined thickness is formed by repeating printing and drying the material of upper-surface electrode 13 to form upper surface electrodes 13 by firing at once. The firing may be executed after the materials are formed at once to have the predetermined thickness, thereby improving productivity. Resistive elements 12 contacting insulating wafer 21 (insulating substrate 11) and at least a part of upper-surface electrodes 13 contacting insulating wafer 21 contain glass to enhance adhesiveness of resistive elements 12 and upper-surface electrodes 13 with insulating wafer 21.

Figure 4A:
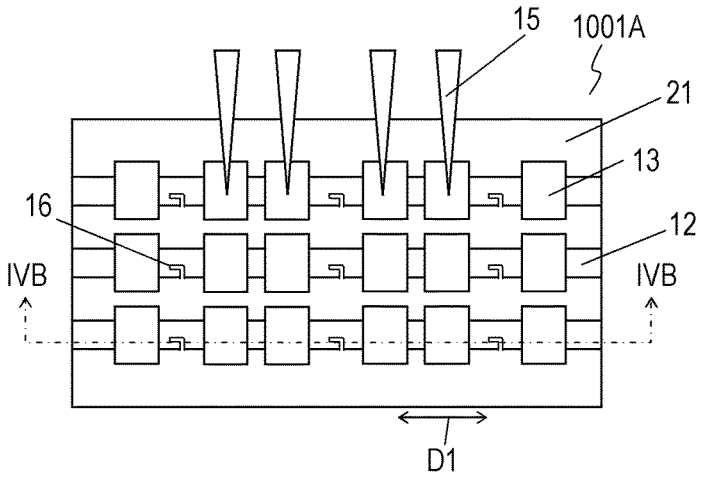
FIG. 4A is a top view of the insulating wafer for illustrating the method of manufacturing the chip resistor according to the embodiment.
Figure 4B:
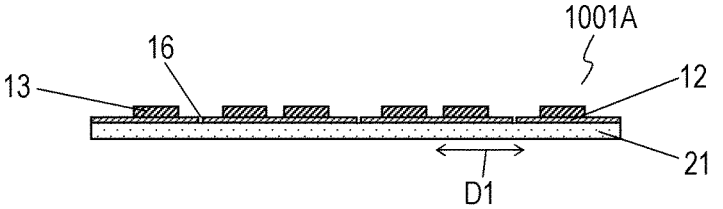
FIG. 4B is a cross-sectional view of the insulating wafer on line IVB-IVB shown in FIG. 4A.

FIG. 4A is a top view of insulating wafer 21. FIG. 4B is a cross-sectional view of insulating wafer 21 on line IVB-IVB shown in FIG. 4A. Next, as shown in FIG. 4A and FIG. 4B, while probes 15 for measuring a resistance contact upper-surface electrodes 13 adjacent to each other in intermediate component 1001A and measure the resistances of resistive elements 12, a laser beam having diameters ranging from 20 μm to 70 μm is applied to resistive element 12 to form trimming groove 16 to adjust the resistance so that resistive elements 12 have predetermined resistances. Trimming grooves 16 is not necessarily formed with a laser beam.

Figure 4C:
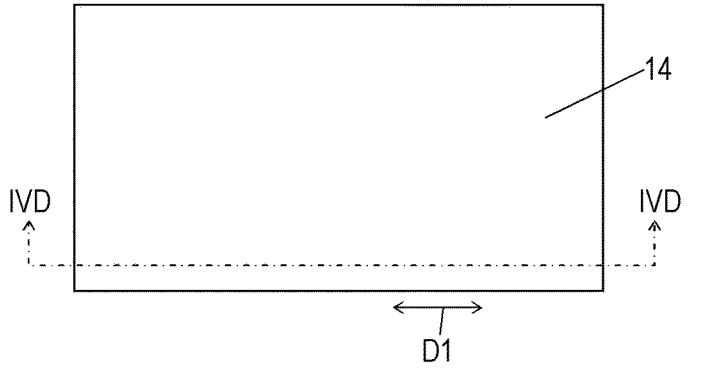
FIG. 4C is a top view of the insulating wafer for illustrating the method of manufacturing the chip resistor according to the embodiment.
Figure 4D:
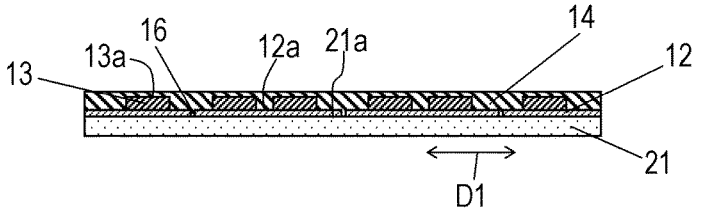
FIG. 4D is a cross-sectional view of the insulating wafer on line IVD-IVD shown in FIG. 4C.

FIG. 4C is a top view of insulating wafer 21. FIG. 4D is a cross-sectional view of insulating wafer 21 on line IVD-IVD shown in FIG. 4C. Next, as shown in FIG. 4C and FIG. 4D, protective layer 14 is formed by screen printing, firing, or hardening glass or epoxy-resin paste on upper surfaces 12*a*, 13*a*, and 21*a* of insulating wafer 21, resistive elements 12, and upper-surface electrodes 13 so as to cover all of insulating wafer 21, resistive elements 12, and upper-surface electrodes 13 of intermediate component 1001A. Protective layer 14 may be formed by spray or clipping.

Figure 5A:
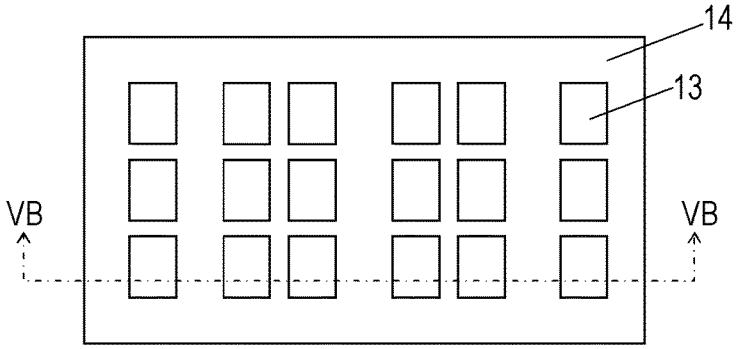
FIG. 5A is a top view of the insulating wafer for illustrating the method of manufacturing the chip resistor according to the embodiment.
Figure 5B:
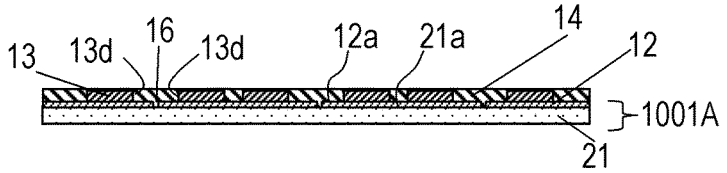
FIG. 5B is a cross-sectional view of the insulating wafer on line VB-VB shown in FIG. 5A.

FIG. 5A is a top view of insulating wafer 21. FIG. 5B is a cross-sectional view of insulating wafer 21 on line VB-VB shown in FIG. 5A. Next, as shown in FIG. 5A and FIG. 5B, protective layer 14 is polished by a back-grind method, a polishing method, or a file until upper surface electrodes 13 are exposed. At this moment, the thickness of exposed upper surface electrodes 13 is substantially equal to a thickness of polished protective layer 14, in other words, upper surfaces 13*a* of upper surface electrodes 13 are flush with upper surface 14*a* of protective layer 14 near upper surface electrodes 13. As a result, upper surfaces 13*a* of the pair of upper-surface electrodes 13 can be smoothened, and surfaces 13*d* of the pair of upper-surface electrodes 13 facing each other are covered with protective layer 14 so as not to be exposed from protective layer 14. Respective parts of surface layer of upper-surface electrodes 13 may be polished simultaneously.

Figure 5C:
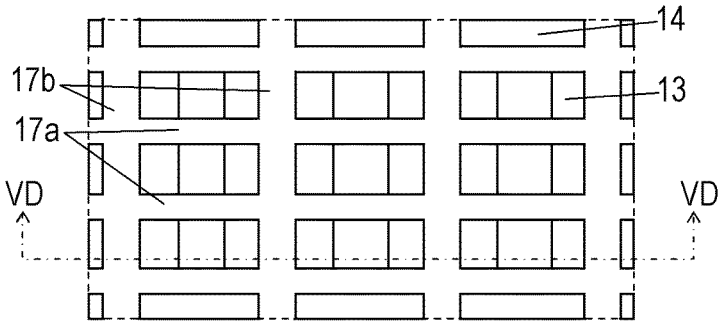
FIG. 5C is a top view of the insulating wafer for illustrating the method of manufacturing the chip resistor according to embodiment.
Figure 5D:
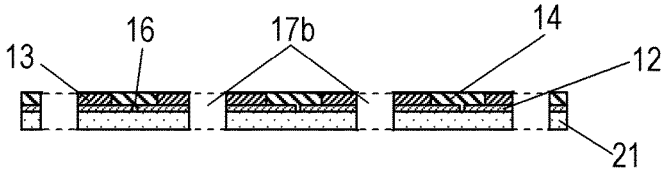
FIG. 5D is a cross-sectional view of the insulating wafer online VD-VD shown in FIG. 5C.
Figure 5E:
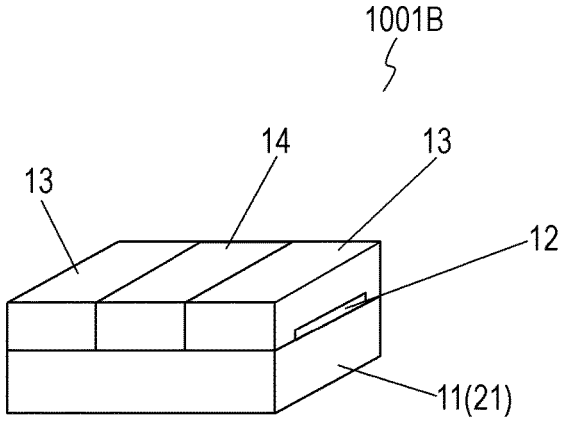
FIG. 5E is a perspective view of the chip resistor according to the embodiment for illustrating the method of manufacturing the chip resistor.

FIG. 5C is a top view of insulating wafer 21. FIG. 5D is a cross-sectional view of insulating wafer 21 on line VD-VD shown in FIG. 5C. Next, as shown in FIG. 5C and FIG. 5D, insulating wafer 21 is cut at cutting portions 17*a* extending in a longitudinal direction (direction D1) and cutting portions 17*b* extending in a lateral direction (direction D2). At this moment, insulating wafer 21 is cut in the longitudinal direction (direction D1) at a portion between upper-surface electrodes 13 adjacent to each other in the lateral direction (direction D2) which does not have trimming grooves 16 formed therein. Insulating wafer 21 is cut in the lateral direction (direction D2) so as to expose side surfaces of upper surface electrodes 13. Resistive element 12 is exposed to cutting portions 17*b* extending in the lateral direction (direction D2). FIG. 5E is a perspective view of chip 1001B obtained by cutting insulating wafer 21 at cutting portions 17*a* and 17*b*. This cutting is carried out by dicing, and burrs of chip 1001B may be removed in accordance with needs after the cutting, thereby providing chip resistor 1001 shown in FIG. 1 and FIG. 2A. The cutting may be carried out by another method, such as laser, pressing. Insulating wafer 21 is cut in the lateral direction (direction D2) unpreferably to have the same width as resistive element 12 since side surfaces of resistive element 12 and trimming grooves 16 are exposed.

As a result of production with insulating wafer 21 having a sheet shape, each of edge surfaces 13*b* of the pair of upper-surface electrodes 13 does not project outward from respective one of edge surfaces 11*b* of insulating substrate 11.

In the drawings, resistive elements 12 after dividing are arranged in three rows in the longitudinal direction and in three columns in the lateral direction. However, the numbers of the rows and the columns are not limited to these numbers.

Figure 9:
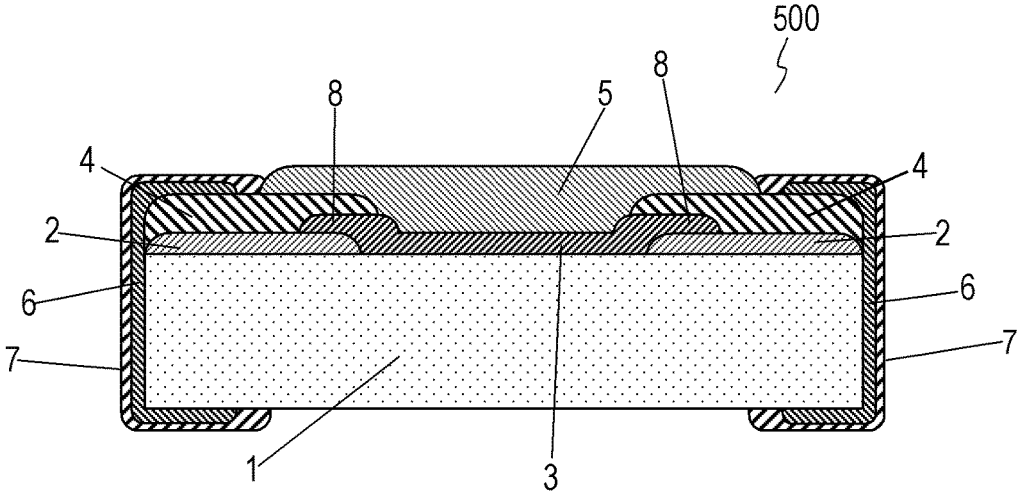
FIG. 9 PRIOR ART
FIG. 9 is a cross-sectional view of a conventional chip resistor.

In conventional chip resistor 500 shown in FIG. 9, protective layer 5 covers connecting portions 8 of the pair of uppermost-surface electrodes 4 and resistive element 3 and the pair of upper-surface electrodes 2. Therefore, electric currents pass through connecting portions 8 via plating layers 7. In connecting portions 8, since CuNi constituting resistive element 3 is diffused in Cu constituting the pair of upper-surface electrodes 2 and the pair of uppermost-surface electrodes 4, temperature coefficient of resistance (TCR) in connecting portion 8 become high, and as a result, a TCR as entire chip resistor 500 becomes high and deteriorated.

In chip resistor 1001 according to the embodiment, since upper surfaces 13*a* of the pair of upper surface electrodes 13 are exposed from protective layer 14, mounting solders 1005 extend to a vicinity of an interface between protective layer 14 and each of upper surface electrodes 13. As a result, an electric current flows in the vicinity of the interface between protective layer 14 and each of upper-surface electrodes 13. Therefore, the electric current pass through only a part of the connecting portion at which each of the pair of upper-surface electrodes 13 is connected to resistive element 12 so as to flow the shortest path, but does not pass through almost at all. As a result, the TCR can be reduced and improved. Moreover, edge surfaces 13*b* of the pair of upper-surface electrodes 13 are exposed, and edge surfaces 13*b* of the pair of upper-surface electrodes 13 do not project from edge surfaces 11*b* of insulating substrate 11. Therefore, in a case of production in a sheet shape, dividing can be carried out at edge surfaces 11*b* of insulating substrate 11, and as a result, productivity of chip resistor 1001 is improved.

Figure 6:
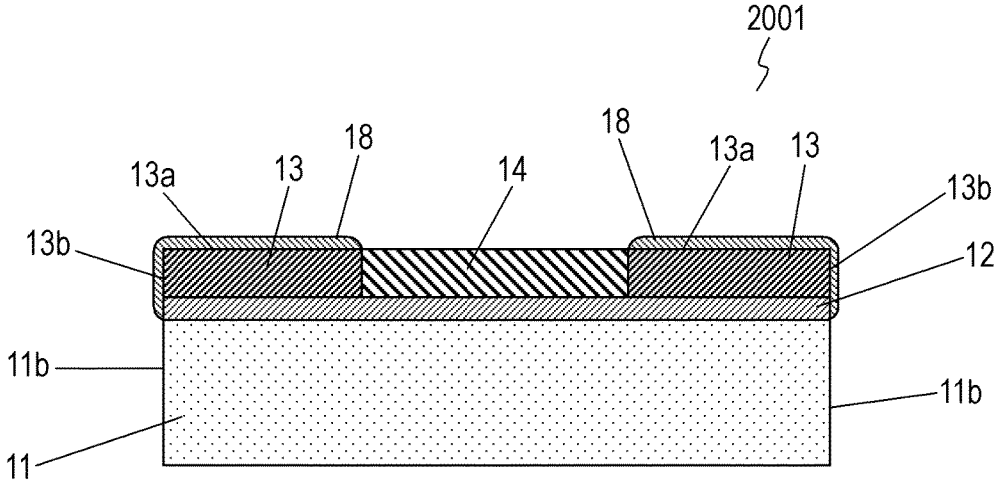
FIG. 6 is a cross-sectional view of another chip resistor according to the embodiment.

FIG. 6 is a cross-sectional view of another chip resistor 2001 according to the embodiment. In FIG. 6, components identical to those of chip resistor 1001 shown in FIG. 1, FIG. 2A, and FIG. 2B are denoted by the same reference numerals. Chip resistor 2001 shown in FIG. 6 further includes a pair of plating layers 18 provided on upper surfaces 13*a* and edge surfaces 13*b* of the pair of exposed upper-surface electrodes 13 of chip resistor 1001 shown in FIG. 1, FIG. 2A, and FIG. 2B, respectively. Plating layers 18 can include fillets extending from edge surfaces 13*b* of upper surface electrodes 13 toward edge surfaces 11*b* of insulating substrate 11 along edge surfaces 12*b* of resistive element 12, and improve adhesiveness with mother board 1002. Plating layer 18 includes at least an Ni plating layer provided on upper surface 13*a* and edge surface 13*b* of upper-surface electrode 13 and on edge surface 12*b* of resistive element 12 and has an Sn plating layer provided on the Ni plating layer. Plating layer 18 extends to edge surface 12*b* of resistive element 12. Since edge surfaces 13*b* of the pair of upper-surface electrodes 13 are also exposed, plating layers 18 are formed also on edge surfaces 13*b*, thereby further improving adhesiveness with mother board 1002.

Figure 7A:
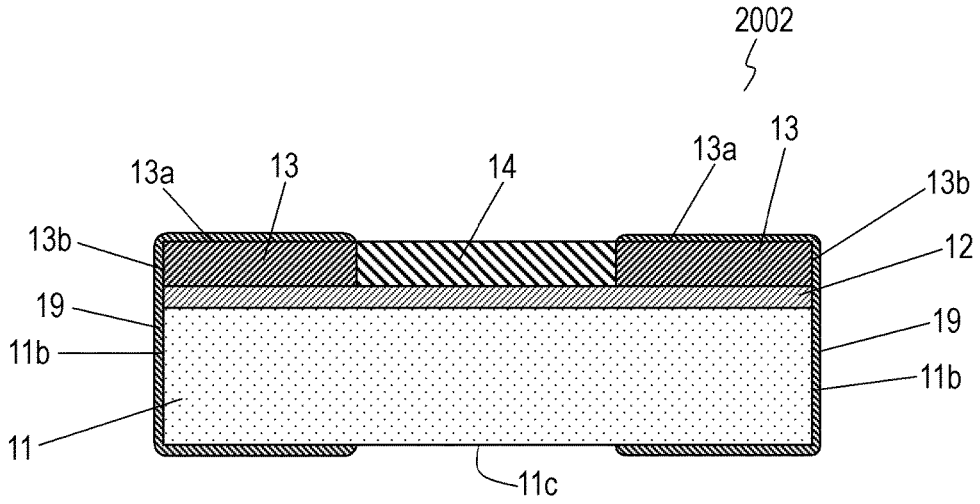
FIG. 7A is a cross-sectional view of still another chip resistor according to the embodiment.

FIG. 7A is a cross-sectional view of still another chip resistor 2002 according to the embodiment. In FIG. 7A, components identical to those of chip resistor 1001 shown in FIG. 1, FIG. 2A, and FIG. 2B are denoted by the same reference numerals. Chip resistor 2002 shown in FIG. 7A further includes a pair of sputter layers 19 each formed from respective one of upper surfaces 13*a* and respective one of edge surfaces 13*b* of the pair of exposed upper surface electrodes 13 of chip resistor 1001 shown in FIG. 1 and FIG. 2A, FIG. 2B to lower surface 11*c* of insulating substrate 11. More specifically, each of sputter layers 19 is provided on respective one of upper surfaces 13*a* of upper-surface electrodes 13, respective one of edge surfaces 13*b* of upper-surface electrodes 13, respective one of edge surfaces 12*b* of resistive element 12, respective one of edge surfaces 11*b* of insulating substrate 11, and respective one of lower surface 11*c* of insulating substrate 11. Sputter layer 19 is formed by sputtering a metal material and has a cross section having a U-shape. This configuration allows sputter layers 19 to include large fillets formed to edge surfaces 12*b* of resistive element 12 and edge surfaces 11*b* and lower surface 11*c* of insulating substrate 11, and improves heat dissipation performance, accordingly increasing the rated electric power of chip resistor 2002.

Figure 7B:
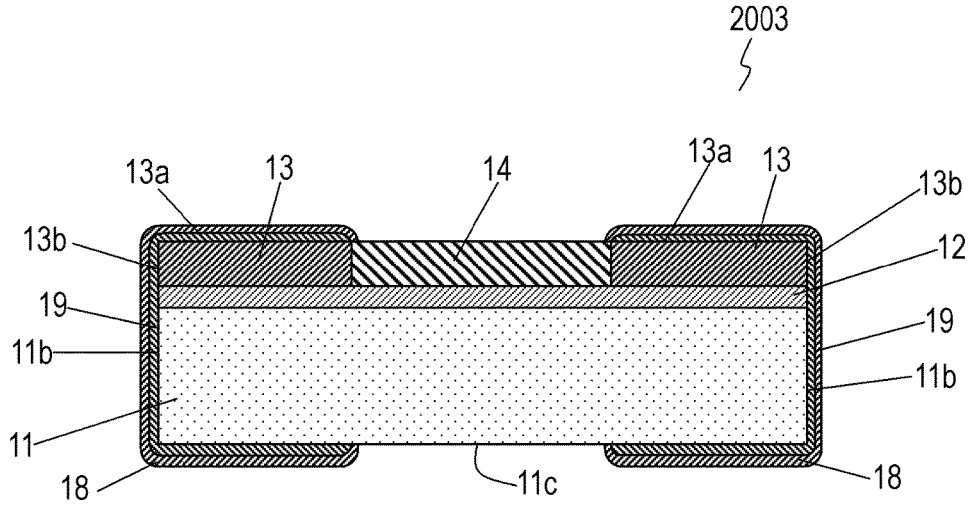
FIG. 7B is a cross-sectional view of a further chip resistor according to the embodiment.

FIG. 7B is a cross-sectional view of further chip resistor 2003 according to the embodiment. In FIG. 7B, components identical to those of chip resistor 2002 shown in FIG. 7A are denoted by the same reference numerals. Chip resistor 2003 shown in FIG. 7B further includes a pair of plating layers 18 provided on entire surfaces or partial surfaces of the pair of sputter layers 19 of chip resistor 2002 shown in FIG. 7A, respectively. This configuration allows sputter layers 19 to include large fillets formed to edge surfaces 12*b* of resistive element 12 and edge surfaces 11*b* and lower surface 11*c* of insulating substrate 11, and improves heat dissipation performance, accordingly increasing the rated electric power of chip resistor 2002.

Figure 8:
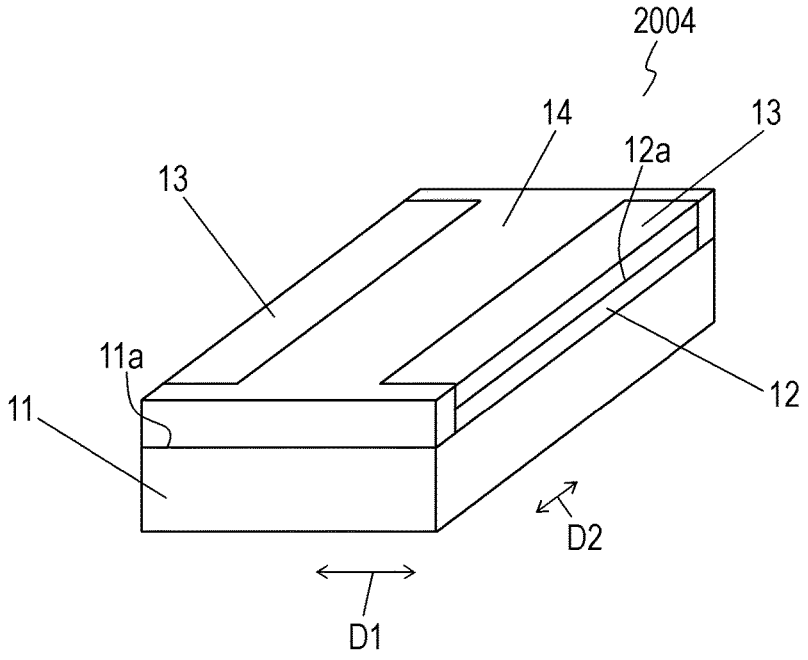
FIG. 8 is a perspective view of a further chip resistor according to the embodiment.

FIG. 8 is a cross-sectional view of further chip resistor 2004 according to the embodiment. In FIG. 8, components identical to those of chip resistor 1001 shown in FIG. 1, FIG. 2A, and FIG. 2B are denoted by the same reference numerals. In chip resistor 1001 shown in FIG. 1, FIG. 2A, and FIG. 2B, the width of upper surface 11*a* of insulating substrate 11 in direction D1 is larger than the width of upper surface 11*a* in direction D2, and the pair of upper-surface electrodes 13 are formed at the short sides of insulating substrate 11. In chip resistor 2004 shown in FIG. 8, the width of upper surface 11*a* of insulating substrate 11 in direction D2 is larger than the width of upper surface 11*a* in direction D1, and the pair of upper surface electrodes 13 are formed at the long sides of upper surface 11*a* having the rectangular shape. In chip resistor 2004, upper surface electrodes 13 do not projected from upper surface 12*a* of resistive element in direction D1 or D2, and protective layer 14 extends in direction D2 along upper surface 11*a* of insulating substrate 11 at both sides of upper-surface electrodes 13.

In chip resistors 1001, 2001 to 2004, a pair of uppermost-surface electrodes may be provided on the pair of upper-surface electrodes 13, and resistive element 12 may be formed between the pair of upper-surface electrodes 13 and between the pair of uppermost-surface electrodes. In this chip resistor, a part of resistive element 12 covers the pair of uppermost-surface electrodes, a thickness of the pair of uppermost-surface electrodes is larger than the thickness of the pair of upper-surface electrodes 13, the specific resistance of the pair of uppermost-surface electrodes are smaller than specific resistance of the pair of upper-surface electrodes 13, and the pair of uppermost-surface electrodes are connected to plating layers 18.

In the embodiments, terms, such as "upper surface", indicating directions indicate relative directions determined only by relative positional relations of constituent components, such as insulating substrate 11 and resistive element 12, members of chip resistors, and do not indicate absolute directions, such as a vertical direction.

INDUSTRIAL APPLICABILITY

A chip resistor according to the present invention can improve a TCR and are particularly useful in low-resistance chip resistors used in various electronic devices.

REFERENCE MARKS IN THE DRAWINGS

11 insulating substrate
12 resistive element
13 upper-surface electrode
14 protective layer
18 plating layer
1001, 2001, 2002, 2003, 2004 chip resistors
1001A intermediate component

The invention claimed is:

1. A chip resistor comprising:

an insulating substrate having an upper surface and edge surfaces;

a resistive element provided on the upper surface of the insulating substrate;

a pair of upper-surface electrodes provided on respective ones of both end portions of an upper surface of the resistive element so as to expose a part of an upper surface of the resistive element from the upper-surface electrodes; and a protective layer that covers the part of the resistive element and that does not cover the pair of upper-surface electrodes, wherein each of the pair of upper-surface electrodes has an exposed upper surface, and an exposed edge surface, and a lower surface disposed on the upper surface of the insulating substrate, wherein the edge surface of each of the pair of upper-surface electrodes does not project outward from respective one of the edge surfaces of the insulating substrate, wherein the exposed upper surface of each of the pair of upper-surface electrodes is flush with an upper surface of the protective layer, wherein a thickness of each of the pair of upper surface electrodes is equal to a thickness of the protective layer, wherein each of the pair of upper surface electrodes has the same composition from the lower surface of each of the pair of upper surface electrodes to the exposed upper surface of each of the pair of upper surface electrodes.

2. The chip resistor according to claim 1, further comprising a pair of plating layers, a respective one of the pair of plating layers being provided on the upper surface and the edge surface of each of the pair of upper-surface electrodes.

3. A method of manufacturing a chip resistor, comprising:

providing an intermediate component including:

an insulating substrate, a resistive element provided on an upper surface of the insulating substrate, and a pair of upper-surface electrodes provided on both end portions of an upper surface of the resistive element, respectively, so as to expose a part of an upper surface of the resistive element from the pair of upper-surface electrodes;

forming a protective layer covering the pair of upper-surface electrodes of the intermediate component and the part of the upper surface of the resistive element; and polishing the protective layer so as to reduce a thickness of the protective layer to allow each of the pair of upper-surface electrodes to have an upper surface exposed from the protective layer, and to allow the exposed upper surface of each of the pair of upper-surface electrodes to be flush with an upper surface of the protective layer, such that a thickness of each of the pair of upper surface electrodes is equal to the reduced thickness of the protective layer.

4. The method according to claim 3, wherein the insulating substrate further has edge surfaces;

wherein each of the pair of upper-surface electrodes further has an edge surface exposed from the protective layer; and wherein the edge surface of each of the pair of upper-surface electrodes does not project outward from respective one of the edge surfaces of the insulating substrate.

5. The chip resistor according to claim 1, wherein the exposed upper surface of each of the pair of upper-surface electrodes and the upper surface of the protective layer are aligned in a given plane.

6. The method according to claim 3, wherein the exposed upper surface of each of the pair of upper-surface electrodes and the upper surface of the protective layer are aligned in a given plane.

7. The chip resistor according to claim 1, wherein at least a part of the resistive element contains glass, and the part of the resistive element containing glass contacts the insulating substrate.

8. The chip resistor according to claim 1, wherein at least a part of each of the pair of upper-surface electrodes contains glass, and the part of each of the pair of upper-surface electrodes containing glass contacts the insulating substrate.

9. The method according to claim 3, wherein each of the pair of upper-surface electrodes further has a lower surface disposed on the upper surface of the insulating substrate, and wherein, after said polishing the protective layer, each of the pair of upper-surface electrodes has the same composition from the lower surface of each of the pair of upper-surface electrodes to the exposed upper surface of each of the pair of upper-surface electrodes.

10. The method according to claim 3, wherein at least a part of the resistive element contains glass, the part of the resistive element containing glass contacts the insulating substrate.

11. The method according to claim 3, wherein at least a part of each of the pair of upper-surface electrodes contains glass, the part of each of the pair of upper-surface electrodes containing glass contacts the insulating substrate.

* * * * *